United States Patent [19]

Arment

[11] 4,143,988

[45] Mar. 13, 1979

[54] MANHOLE RISER

[75] Inventor: Ralph M. Arment, Leola, Pa.

[73] Assignee: Aggregates Equipment, Inc., Leola, Pa.

[21] Appl. No.: 928,896

[22] Filed: Jul. 28, 1978

[51] Int. Cl.[2] ..... E02D 29/14

[52] U.S. Cl. ..... 404/26

[58] Field of Search ..... 404/26, 25; 52/19, 20, 52/21; 49/463, 464, 465, 466

[56] References Cited

U.S. PATENT DOCUMENTS

| | | | |
|---|---|---|---|
| 1,458,391 | 6/1923 | Burton | 404/25 |
| 2,431,082 | 11/1947 | Sayles | 404/26 |
| 3,326,100 | 6/1967 | White | 404/26 |
| 3,331,295 | 7/1967 | Sorrell | 404/26 |
| 3,611,889 | 10/1971 | Levinson | 404/26 |

*Primary Examiner*—Nile C. Byers, Jr.

*Attorney, Agent, or Firm*—Martin Fruitman

[57] ABSTRACT

A manhole extension or riser for increasing the height of manhole cover frames when a roadway is resurfaced. It includes roadbed piercing anchors attached to the periphery of a simple ring increasing the height of the frame. The anchors, made of flat steel plates cut into trapezoids, act to lock the riser in place when the new road surface is laid down. A second ring is used to increase the height of the cover support lift.

6 Claims, 1 Drawing Figure

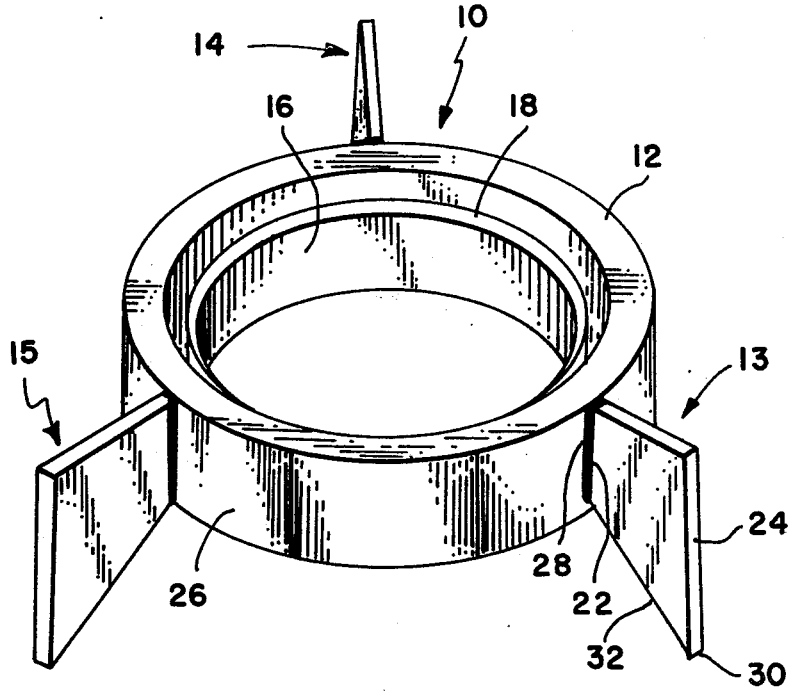
14
10
16
18
12
15
13
24
28
26
22
32
30

MANHOLE RISER

BACKGROUND OF THE INVENTION

This invention relates generally to road structure processes and apparatus, and more specifically to a new apparatus for extending manhole or vault covers to permit adjustment of the cover to a new height of the road surface cause by resurfacing of the road. The need for extensions or risers for manhole covers is well established because of the many road surfacing jobs which are performed every year. The available extensions, however, generally are of a complex configuration, which increases the cost of manufacture and require, during installation, the removal of the old road surface material all the way around the existing manhole. This procedure leads to a considerable cost of installation and forces the operation to be performed well in advance of the actual resurfacing. Since the manhole risers must be placed before the resurfacing, there is always a considerable period of time during which the risers are protrusions in the old road surface causing much distress to the vehicles using the road. It is, therefore, an object of the present invention to supply a manhole cover riser which is simple and inexpensive to manufacture. It is a further object of this invention to supply a riser for which the installation is simple and not a time consuming operation. A still further object of this invention is to supply a manhole cover rise which has available sufficient adjustment to permit accommodation to various thicknesses of the previously installed manhole cover support.

SUMMARY OF THE INVENTION

These and other objects may be obtained by the use of the invention herein described where the preferred embodiment is a manhole extension with anchors which are attached to the periphery of the outer metal ring. The outer ring is a height equivalent to the anticipated depth of the new road surface to be laid. The thickness of the outer metal ring is selected to be approximately that of the manhole frame which is being extended, while the inside diameter of the outer metal ring is exactly equal to that of the manhole frame being extended. An inner ring is fitted concentric to the other ring to form a lip to support the manhole cover. The fit of the inner ring is such that it slips easily into the outer ring but without excessive clearance.

The preferred embodiment of the invention has trapezoidal plate anchors attached permanently to the outside vertical surface of the outer ring, preferably by welding, and oriented so that the sharp angle of the anchor plate clears the circumference of the old manhole frame. The lowermost part of the anchor plate, that portion sharpened to a point, extends somewhat below the lowest surface of the outer ring. This permits embedding a portion of the anchor below the surface of the old roadway.

The new road surface then encases the anchors and the circumference of the riser and locks the assembly in place.

BRIEF DESCRIPTION OF THE DRAWING

The FIGURE is a perspective view of the preferred embodiment of the invention.

DETAILED DESCRIPTION OF THE INVENTION

The preferred embodiment of the invention selected for illustration is shown pictorially in the FIGURE which shows manhole riser 10 before installation. Manhole riser 10 is constructed of a metal outer ring 12 to which trapezoidal anchors 13, 14 and 15 are welded. Inner ring 16 fits into outer ring to form support lip 18. Trapezoidal anchors 13, 14 and 15 are oriented so that edges 22 and 24 are parallel to the axis and vertical circumference 26 of outer ring 12. Anchors 13, 14 and 15 are welded to vertical circumference 26 at welds 28.

The vertical measurement of outer ring 12 is determined by the anticipated depth of the new road surface, and the height of inner ring 16 is normally the same as outer ring 12. Angle anchors 13, 14 and 15 for the preferred embodiment are welded approximately flush with the top of the outer ring and extend several inches below the lowest point of outer ring 12. At least three angle anchors approximately equidistant around the circumference are desirable for proper stability. Installing the preferred embodiment during road construction is a very simple procedure. Outer ring 12 is simply aligned on top of the existing manhole frame, and a sledgehammer is used to drive points 30 of trapezoidal anchors 13, 14 and 15 into the existing roadway. No removal of existing roadway material is required, and angular edge 32 of the trapezoidal anchors yields sufficient clearance to prevent any interference with the existing manhole frame.

This work can be done just before the actual installation of the new roadway, since no removal of the old roadway is necessary and no special tools are required. Installation of the new roadway then encases the riser and anchors with new material and makes the installation permanent.

Use of the old manhole cover is made possible by slipping inner ring 16 into outer ring 12 and letting it settle onto the cover support lip in the original frame. This effectively raises the cover support lip the same amount as the outer frame, and therefore makes the old cover reuseable by placing it on support lip 18.

It is to be understood that the form of the invention herein shown is merely a preferred embodiment. Various changes may be made in the shape, size or arrangements of parts; equivalent means may be substituted for those illustrated and described and certain features may be used independently from other features without departing from the spirit and scope of the invention.

What is claimed as new and desired to be secured by Letters Patent of the United States is:

1. A riser for a manhole frame comprising:

an outer ring of the same inner diameter as the manhole frame being extended, with an outer diameter approximately the same as the manhole frame being extended, and with a height equal to the anticipated depth of the new road surface to be installed; and at least three pointed trapezoidal plate anchors rigidly attached to the outer circumference of the outer ring with the points of said trapezoidal anchors extending below the lowermost surface of the outer ring.

2. A riser for a manhole frame as in claim 1 wherein the trapezoidal plate anchors are constructed with a horizontal top edge and with two vertical edges of unequal length, the shorter edge rigidly attached to the outer ring, and the longer edge oriented on the same radial line of the outer ring as the shorter edge but more remote from the axis of the outer ring than the shorter edge, thereby forming the points on the trapezoidal plates anchors which are remote from the outer cylinder.

3. A riser for a manhole as in claim 1 wherein the trapezoidal anchors are attached by welding.

4. A riser for a manhole as in claim 1 wherein the trapezoidal anchors are spaced equidistantly around the circumference of the outer ring.

5. A riser for a manhole as in claim 1 further comprising:

an inner ring, the outside diameter of which fits into the outer ring.

6. A riser for a manhole as in claim 5 wherein the length of the inner ring is the same as the length of the outer ring.

* * * * *